United States Patent [19]

Gustafson et al.

[11] Patent Number: 4,974,741

[45] Date of Patent: Dec. 4, 1990

[54] INSULATED CARRIER FOR A BEVERAGE CONTAINER

[76] Inventors: Geoffrey F. Gustafson, 2300 Contra Costa Blvd., Suite 330 Pleasant Hill, Calif. 94542; Ronald L. Mendez, 425 Lipine Cir., Vacaville, Calif. 95687

[21] Appl. No.: 385,098

[22] Filed: Jul. 24, 1989

[51] Int. Cl.[5] ..... B65D 7/42

[52] U.S. Cl. ..... 220/85 H; 206/486; 215/100 R

[58] Field of Search ..... 220/85 H, 85 CH; 206/486; 215/100 R

[56] References Cited

U.S. PATENT DOCUMENTS

| | | | |
|---|---|---|---|
| 3,107,028 | 10/1963 | Robertis | 220/85 H |
| 3,624,788 | 11/1971 | McMahon et al. | 220/85 H |
| 3,844,459 | 10/1974 | Chambers . | |
| 4,040,549 | 8/1977 | Sadler | 220/85 H |
| 4,069,996 | 1/1978 | Koziol | 229/1.5 H |
| 4,127,211 | 11/1978 | Zerbey | 220/85 H |
| 4,459,827 | 7/1984 | Rhodes . | |
| 4,690,271 | 9/1987 | Zak | 206/486 |
| 4,735,333 | 4/1988 | Lay et al. . | |
| 4,813,558 | 3/1989 | Fujiyoshi | 220/85 H |
| 4,815,999 | 3/1989 | Ayon et al. . | |
| 4,854,468 | 8/1989 | Dahlquist, II et al. | 220/85 H |

*Primary Examiner*—Joseph Man-Fu Moy

[57] ABSTRACT

A thermally insulated carrier with a tubular housing which accepts single or two serving beverage containers is adapted to be use with a beverage can holder of a vehicle. A base extension attached to the bottom of the insulated carrier is sized to removably fit into the can holder of the vehicle and maintain the insulated carrier stabilized for use.

4 Claims, 6 Drawing Sheets

INSULATED CARRIER FOR A BEVERAGE CONTAINER

BACKGROUND OF THE INVENTION

1. Field of the Invention

This invention relates to thermally insulated holders or carriers adapted for use with single or two serving beverage containers. The invention is primarily directed for use with typical twelve fluid ounce beverage cans, however, it can also function with many bottled beverages.

2. Description of the Prior Art

Single or two serving beverage containers normally holding twelve fluid ounces have become extremely popular. Packaging beverages such as beer and soft drinks for public consumption in single or two serving containers has become extensive, especially the packaging of beverages in cans. These single or two serving cans are most often manufactured of aluminum, a metal which has good thermal conductivity. Unfortunately, the good thermal conductivity of the aluminum can quite often leaves the individual with a luke warm drink half way through the beverage. This has lead to the development of a variety of insulated beverage container holders adapted to assist in maintaining the temperature of the drink.

As American society today is very mobile, people tend to take canned drinks with them most everywhere they go. Beverage cans can be seen in automobiles, in boats, in airplanes, and on golf courses, particularly in and around golf carts. In the last few years, manufacturers of automobiles, trucks, boats, and other vehicles, have started to install beverage can holders as integral parts or addable parts. These can holders are normally structured to hold the most popular sized beverage cans which are currently the twelve fluid ounce size in America. Practically none of the beverage container holders in vehicles offer any significant insulation factor to keep a cooled beverage from rapidly becoming warm. Also, no provision is usually made in the holder hole size to accept anything other than the popular twelve fluid once beverage can. Therefore, the provided can holders in vehicles are useless for retaining a beverage can when in an auxiliary insulated holder.

There appears to have been no attempts made to solve the insulated container size problem relative to standard vehicular mounted beverage container holders in the past art patents we examined. In fact, the trend seems to be toward decorative and unusual insulated can holder forms. This is seen in U.S. Pat. No. 4,735,333, dated Apr. 5, 1988, granted to Lay et al for a single beverage can holder with lid, and in the Ayon et al U.S. Pat. No. 4,815,999, dated Mar. 28, 1989, for a beverage holder with lid which simulates a puppet in appearance. A mountable carrying case for canned beverages is seen in U.S. Pat. No. 3,844,459, issued on Oct. 29, 1974, to James L. Chambers. The Chambers case is adapted to be mounted to a tubular framing member of a golf cart. Also the Duane C. Rhodes patent granted July 17, 1984, U.S. Pat. No. 4,459,827, teaches a golf bag cooler kit for two canned beverages which is mounted to the side of a golf bag.

None of the past art patents show any devices directed towards a insulated holder useful by insertion into beverage can holders currently provided in most boats, golf carts, and road vehicles. We therefore feel our invention discloses new useful improvements and advantages not available in the market place or presented or anticipated in past art devices.

SUMMARY OF THE INVENTION

In practicing our invention, we provide an insulated carrier for beverage containers in the form of an auxiliary insulated holder structured for supportive insertion into existing beverage holders in vehicles, boats, golf carts and the like. Our can holder is formed as a cylindrical tube with insulated sidewalls, and may optionally have a removable insulated lid. The lid can be a flat round lid with insert collars or have a convex top with a designed finish such as a half of a golf ball or a half of a baseball for appearance purposes. The device has a closed bottom, and an interior hollow area between the insulated sidewalls, with the internal diameter of the hollow area sufficient to slidably accept a single beverage container. Unique to the immediate invention is a downwardly projecting cylindrical extension attached to the outer surface of the closed bottom as a bottom support base. The cylindrical extension has an outer diameter sized for insertion into pre-existing beverage holders. The cylindrical extension provides retained security for the upper insulated carrier. The structure of the extension is sized to fit slidably into existing container receptacles and in some embodiments of the invention, the extension is tapered or has a pliable exterior wall allowing the cylindrical extension to fit snugly into a variety of slightly different sized container receptacles in vehicles. The extended cylindrical bottom support base may by affixed to the carrier as an extended part or removably attached. Notches designed for easy gripping of the top portion of the can are cut in the upper rim of the beverage carrier sidewalls. A portion of the upper sidewall rim may also notched so the user can drink from the container without removing the can from the can holder if desired. The optional removable lid is provided to help maintain a lower temperature and prevent debris from entering the opened beverage can.

Our invention can be manufactured from a variety of thermal insulating materials including closed cell foamed plastics, semi-rigid foam resins, thermal gels or combinations of these materials. As previously stated, the bottom tubular projection or support base can be inherent to the holder or detachable. With the support base detached, the device can sit flush on flat surfaces, although the holder will still maintain an upright position even with the support base affixed.

Therefore, it is a primary object of our invention to provide a thermally insulated carrier for a single or two serving beverage container which can be inserted into existing beverage holders of cars, boats, golf carts and the like.

A further object of our invention is to provide a thermally insulated carrier for a beverage container which is relatively simple and inexpensive to produce using well known manufacturing techniques.

Other objects and advantages of the present invention which are believed to be novel may be best understood by reference to the following description, examined concurrently with the accompanying numbered drawings.

BRIEF DESCRIPTION OF THE DRAWINGS

FIG. 5 is a perspective view of a designed convex lid applicable to the carrier with the lid adapted to simulate a golf ball.

FIG. 6 is a perspective view of a designed convex lid applicable to the carrier with the lid adapted to simulate a base ball.

DESCRIPTION OF THE PREFERRED EMBODIMENTS

Figure 1:
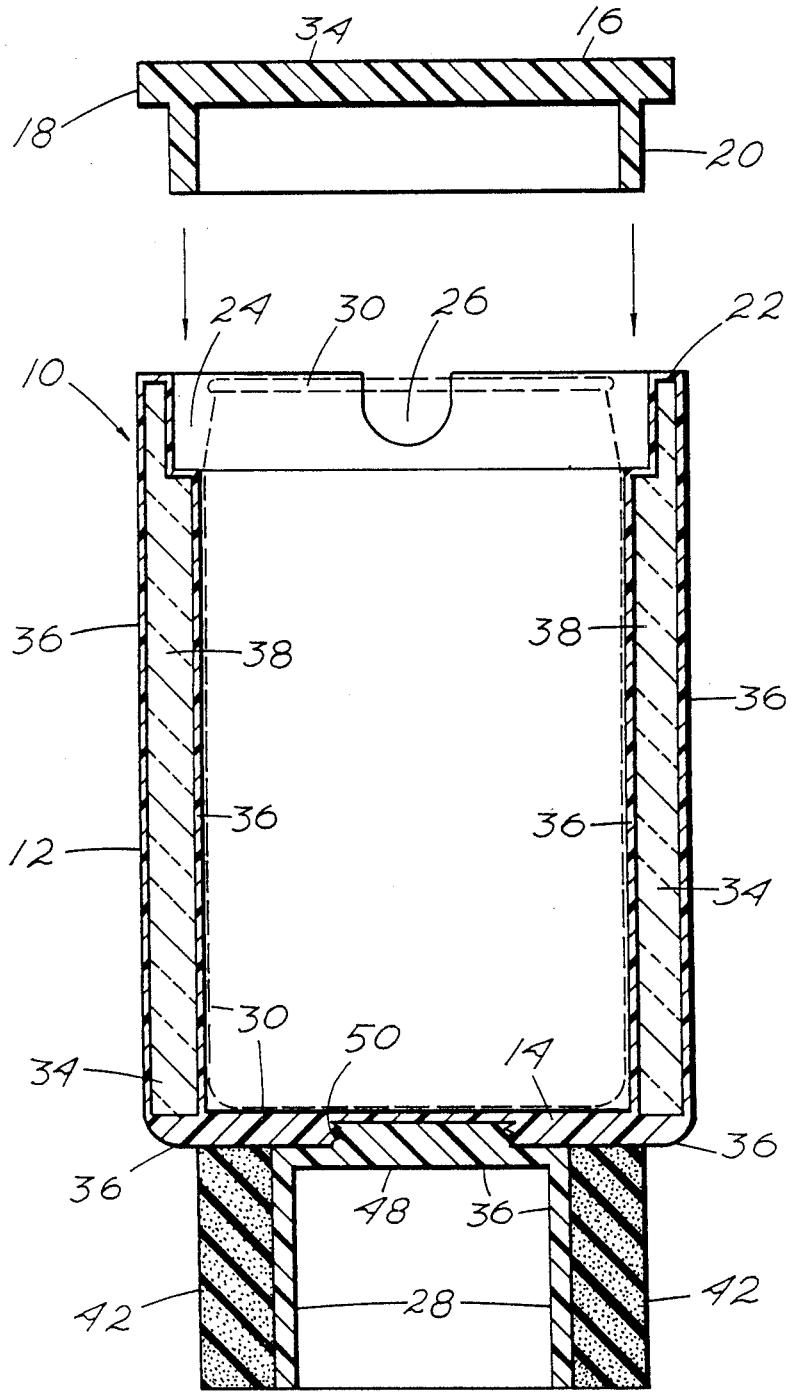
FIG. 1 is a cross-sectional side view of the beverage container carrier embodied with an inner layer of a thermal insulating medium and with an outer layer of water repellant plastic. The bottom support base is shown affixed with a soft resilient foam material which conforms to the interior diameter of the beverage holder of a vehicle. The bottom support base is also shown as a separate detachable unit.

Referring now to the drawings where the invention is illustrated in various views and the number 10 generally references various embodiments of the carrier according to the invention. In FIG. 1, carrier 10 is shown in a sectional view to illustrate internal structure. Carrier housing 12 is an open tubular member sized to slidably contain the standard sized beverage container 30 which could be a bottle or a can generally used as illustrated. Beverage container 30 outlined by dotted lines is shown inside of carrier housing 12 resting on carrier closed bottom 14 in the FIG. 1 illustration. For completely enclosing beverage container 30 and maintaining the insulation factor, lid 16, shown positioned above carrier housing 12 in FIG. 1, is designed to fit the top of carrier housing 12. The upper rim 22 of carrier housing 12 abuts against the lower surface of lid peripheral rim 18 with lid insert collar 20 seated in lid collar receptacle 24. For easy removal of inserted beverage container 30, finger grip notches 26 are cut half circle through upper rim 22 of carrier housing 12. As can be seen in the FIG. 1 illustrated embodiment, carrier housing 12 is formed with water impervious layers 36 as inside and outside retainers for insulation material 34. Impervious layers 36 can be fabricated from most any useful fabric or plastic materials but would be preferably made of a thermoplastic material. No restrictive requirement is imposed on the type of material required for insulation material 34 except that the material used would preferably be a rigid closed cell foam 38 such as polystyrene.

Figure 2:
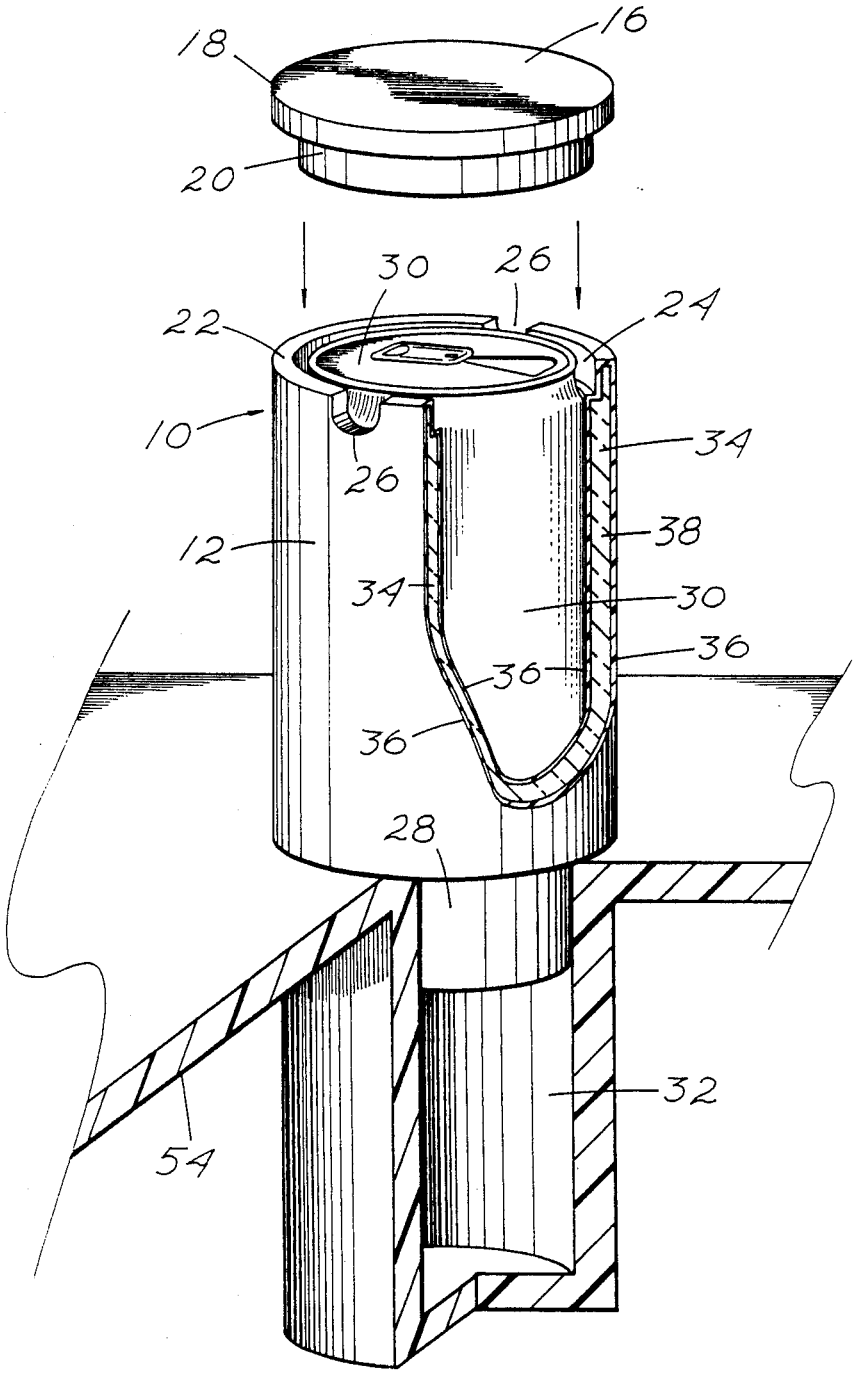
FIG. 2 is a perspective sectional view illustrating the beverage container carrier inserted into a beverage holder. Half circle finger grip openings for can removal are shown cut in the upper rim edge of the carrier.
Figure 3:
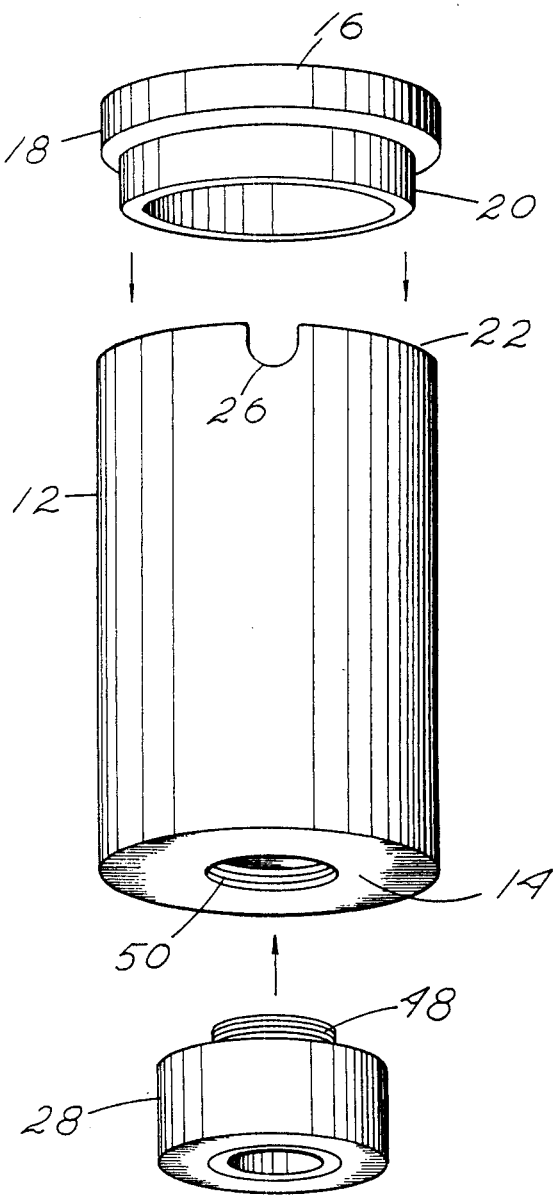
FIG. 3 is a perspective view illustrating the removal of the bottom support base.
Figure 7:
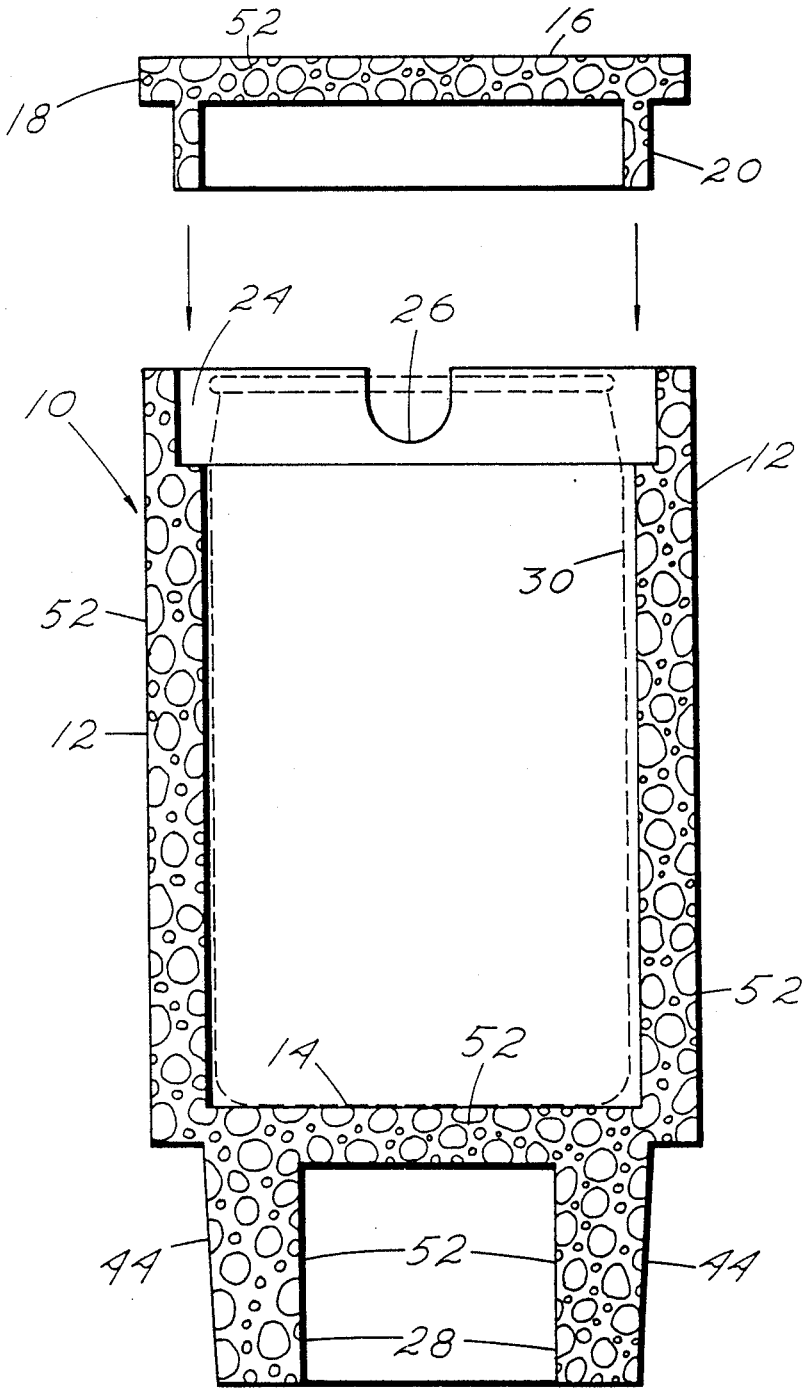
FIG. 7 is a sectional side view of a one unit beverage container carrier according to the invention fabricated of closed cell foamed plastic.

Unique to the invention is support base 28, a cylindrical extension attached to carrier closed bottom 14. Support base 28 is diametrically smaller than carrier housing 12 and is sized to be inserted into a standard can holder 32 as shown in FIG. 2 and FIG. 7. Support base 28 can be manufactured as an integral part of carrier housing 12 as shown in FIG. 7 or detachable as shown in FIG. 1 and FIG. 3. For best fitting diametrical variations in opening sizes of various standard can holders 32, support base 28 can be affixed externally with a resilient and pliable material such as foam rubber 42, illustrated in FIG. 1, or be shaped with tapered support base outer wall 44, illustrated in FIG. 7. Although the special walling described makes support base 28 fit snugly into standard can holder 32 and provides additional security for beverage container 30 in carrier housing 12, a support base 28 with a simple vertical wall sized to insert slidably into standard can holder 32 is an efficient holder for carrier housing 12. See FIG. 3 and FIG. 8. If a tight fit is desired, either the pliability of foam rubber 42 attached to the straight wall of support base 28 or the tapered support base outer wall 44 accomplishes a tight fit in variously sized openings of standard can holder 32. When support base 28 is a detachable member as illustrated in FIG. 1 and FIG. 3, support base threaded insert 48 attaches support base 28 removably to carrier closed bottom 14 by being screwed into support base threaded receiver 50.

FIG. 5 and FIG. 6 illustrate lid 16 fabricated with convex upper surfaces with the upper surfaces simulating half of game balls used for sports. In FIG. 5 lid 16 is shown as convex golf ball designed lid 58. In FIG. 6 lid 16 has an alternate design, convex base ball designed lid 60. These special lids illustrate the variety of uniquely designed lids which can be used with carrier 10.

FIG. 7 illustrates carrier 10 with carrier housing 12 and support base 28 manufactured as a one-piece unit of a light weight resilient semi-rigid plastic foam material 52. This embodiment of carrier 10 does not require a double wall of impervious layer 36 or insulation material 34 as resilient semi-rigid plastic foam material 52 accomplishes both the walling and the insulation. The support base 28 being an integral part of carrier housing 12 and also structured of resilient semi-rigid plastic foam material 52 would be sufficiently pliable and resilient to function as previously described. Tapered support base outer wall 44 as illustrated in FIG. 7 used in a single plastic foam structured carrier 10, would enhance the usage of this embodiment for retentive attachment to standard can holder 32. Lid 16, when manufactured of resilient semi-rigid plastic foam material 52 in a single plastic foam structure as shown in FIG. 7, retains lid peripheral rim 18 and lid insert collar 20 with lid insert collar 20 fitting into lid collar receptacle 24 adjacently inside along upper rim 22 of carrier housing 12. Finger grip notches 26 can also be seen in the FIG. 7 embodiment cut through at the top of upper rim 22 of carrier housing 12. It is to be noted that all embodiments of the immediate invention are designed to be manufactured of light weight materials preferably of a rigid plastic composition.

Figure 8:
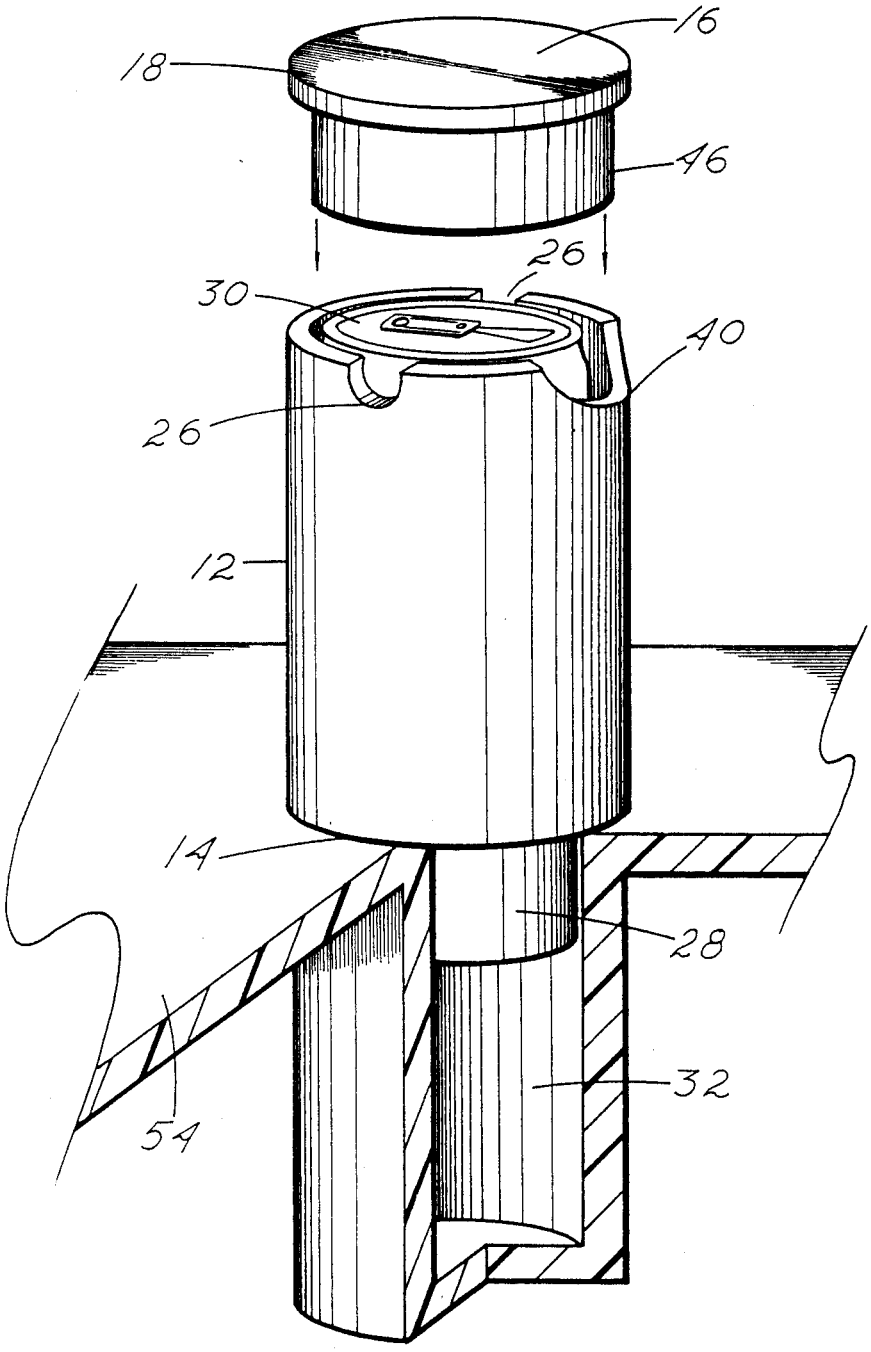
FIG. 8 is a perspective in-use view of the insulated carrier with a beverage container inside illustrating the smaller diameter bottom support base inserted into a beverage holder of a vehicle console. An optional aperture is shown incorporated into the upper rim useful for pouring or drinking from the contained beverage container without removing it from the carrier. The lid is shown adapted for this particular embodiment with an interior fitting extended lower attachment collar to cover the drinking aperture when not in use.

Referring now to FIG. 8 where carrier housing 12 is illustrated with vertically walled support base 28 inserted into standard can holder 32. Standard can holder 32 has been sectionally opened to show how a vertically walled support base 28 fits sufficiently close to retain carrier housing 12 and secure beverage container 30. In the FIG. 8 illustration, lid 16 is affixed with extended lid insert collar 46 to insert further into lid collar receptacle 24 and cover a widened drink-pour notch 40 cut in upper rim 22 of carrier housing 12.

Figure 4:
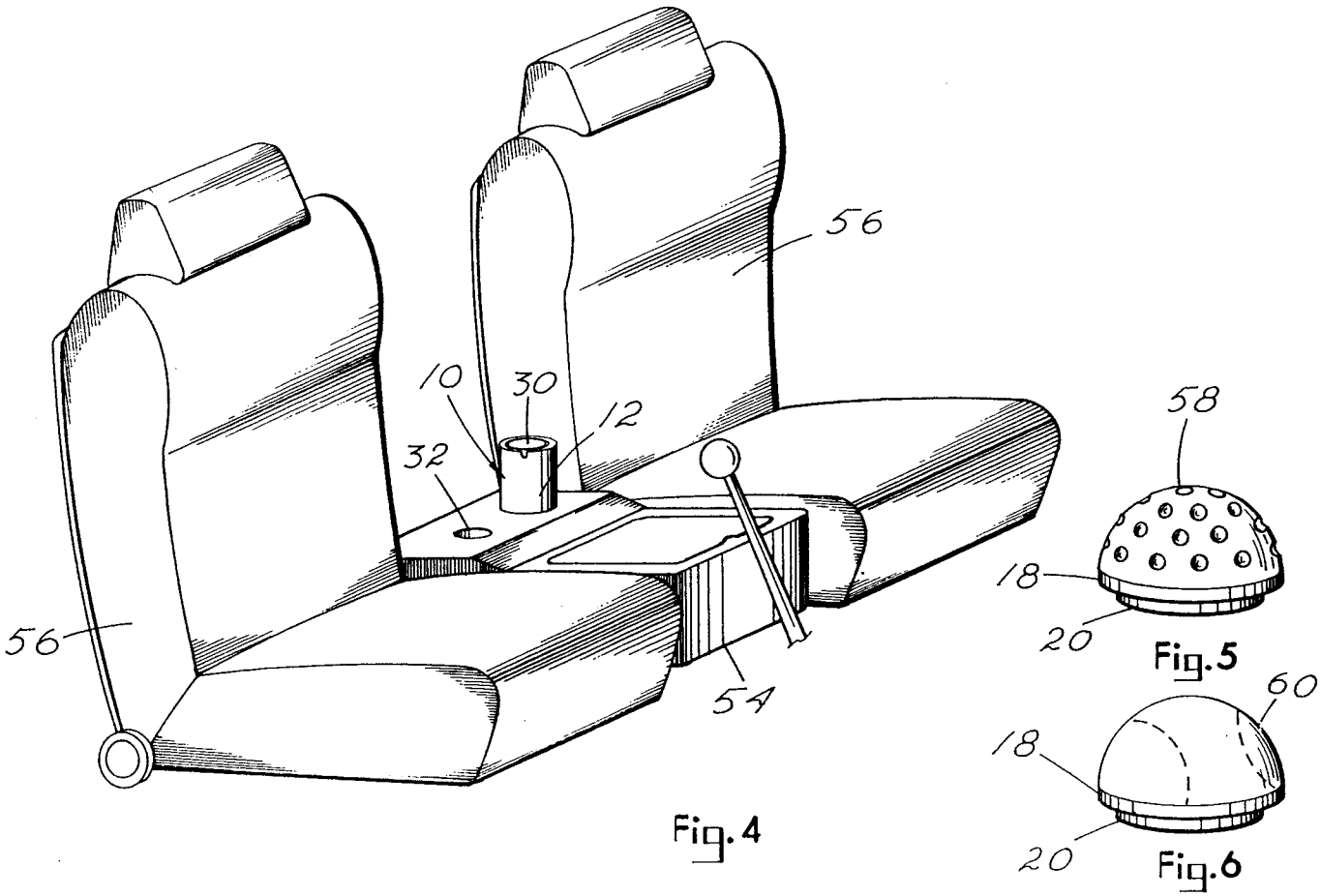
FIG. 4 Illustrates the beverage container carrier inserted into the beverage holder located in the console of a vehicle.

In use as illustrated in FIG. 4, carrier 10 is retained in a standard can holder 32 in the console 54 of a vehicle between seats 56. Support base 28 which can't be seen has been inserted into standard can holder 32 and is supporting carrier housing 12 firmly but removably. A user can drink one-handed by removing beverage container 30 from carrier housing 12 or by lifting the entire carrier 10, drinking and easily replacing carrier 10 back in standard can holder 32 retained handy in console 54. Although embodiments of carrier 10 have been described relative to use between car seats 56 in console 54, carrier 10 is a viable appliance useful wherever standard can holders 32 are available. As beverage container apertures of a standard size are now found in the structure of golf carts, as tray attachments to a variety of vehicles including RV's, boats, and aircraft, the field for applications of various embodiments of carrier 10 herein described appears unlimited.

The invention has been described in the foregoing specification with extensive details in embodiments considered the preferred structuring for the invention at this time. It is, however, apparent that modifications could be made to the invention by those skilled in the art which incorporate our inventiveness. Accordingly, any modifications or similar embodiments made to the invention which fall within the scope of our appended claims, we will consider to be our invention.

What we claim as our invention is:

1. An insulated carrier for a single beverage container adapted for use with a beverage container holder of a vehicle, comprising a housing generally manufactured of thermally insulated materials, said housing having an open end and an oppositely disposed closed bottom end, said housing having an open interior area in communication with said open end adapted to removably retain said single beverage container, said housing having an extending base attached to said closed bottom end, said base having a generally larger exterior diameter than an upper open interior diameter of said beverage container holder of said vehicle, said base having at least an outer surface manufactured of resilient and pliable material adapted to allow insertion of said base into said upper open interior of said beverage container holder with said insertion adapted to compress said resilient and pliable material of said base, said compression adapted to cause tight fitting stability of said insulated carrier in said beverage container holder.

2. The insulated carrier of claim 1 wherein said base is right cylindrically shaped.

3. The insulated carrier of claim 1 wherein said base has a wider said external diameter at said housing attached end than a distal end of said base.

4. The insulated carrier of claim 1 for use with said beverage container holder of said vehicle wherein said interior opening of said beverage container holder is larger in diameter than said beverage container and smaller in diameter than said housing of said insulated carrier.

* * * * *